United States Patent [19]

Sutton

[11] Patent Number: 4,713,018

[45] Date of Patent: Dec. 15, 1987

[54] SLIDING CURRENT INTERCHANGE

[75] Inventor: Quinten H. Sutton, Waukesha, Wis.

[73] Assignee: RTE Corporation, Waukesha, Wis.

[21] Appl. No.: 41,959

[22] Filed: Apr. 24, 1987

[51] Int. Cl.[4] ..... H01R 13/53

[52] U.S. Cl. ..... 439/185; 439/434

[58] Field of Search ..... 439/181, 183, 184, 185, 439/186, 187, 434, 435, 436, 780, 934

[56] References Cited

U.S. PATENT DOCUMENTS

| | | | |
|---|---|---|---|
| 3,930,709 | 1/1976 | Stanger et al. | 339/111 |
| 3,957,332 | 5/1976 | Lambert, III | 439/183 |
| 4,099,155 | 7/1978 | Flatt | 337/249 |
| 4,119,358 | 10/1978 | Tachick et al. | 339/111 |
| 4,131,329 | 12/1978 | Flatt | 339/111 |
| 4,186,985 | 2/1980 | Stepniak et al. | 339/111 |

*Primary Examiner*—Gil Weidenfeld
*Assistant Examiner*—David Pirlot
*Attorney, Agent, or Firm*—James Earl Lowe, Jr.

[57] ABSTRACT

A first connector is used in connecting or disconnecting a high voltage circuit by engagement or disengagement of the first connector with a second connector supporting a second connector contact element. The first connector comprises an insulative housing having an axial passage including an electrically conductive surface fixedly secured within the housing, and a contact assembly disposed in the passage. The contact assembly includes a first connector contact element for engaging the second connector contact element, a guide for guiding the second connector contact element for movement towards the first connector contact element and for evolving arc-quenching gas in response to an arc being struck between the first connector contact element and the second connector contact element, a piston responsive to the evolved gas for displacing the contact assembly towards the second connector contact element, and a member electrically connected to the first connector contact element for providing electrical continuity between the first connector contact element and the housing conductive surface, the member having a knurl in contact with the housing conductive surface.

7 Claims, 3 Drawing Figures

SLIDING CURRENT INTERCHANGE

BACKGROUND OF THE INVENTION

This invention relates to electrical connectors, and, more particularly, to separable electrical connectors suited for use under high voltage conditions.

Even more particularly, this invention relates to gas actuated high voltage bushings having a contact mounted within a bore for reciprocal movement within a bushing housing, such as that illustrated in Flatt U.S. Pat. No. 4,099,155 issued July 4, 1978 and incorporated herein by reference.

Electrical connectors, such as that described in the above Flatt patent, have had a housing having a passage including an electrically conductive surface fixably secured within the housing, and a contact assembly disposed in the passage and movable relative to the housing conductive surface. Such devices have also included a contactor for providing electrical continuity between the contact assembly and the housing conductive surface. As illustrated in the above Flatt patent, and as also illustrated in Stanger et al U.S. Pat. No. 3,930,709 issued Jan. 6, 1976 and Stepniak et al U.S. Pat. No. 4,186,985 issued Feb. 5, 1980, the contactor has often been in the form of a metallic louvered spring member encircling a portion of the contact assembly in an electrically conductive relationship with the contact assembly and the housing conductive surface. Flatt U.S. Pat. No. 4,131,329 issued Dec. 26, 1978 illustrates another type of contactor in the form of an annular compression spring received in an annular groove in the housing conductive surface.

Tachick et al U.S. Pat. No. 4,119,358 issued Oct. 10, 1978 illustrates another type of contactor in the form of a sliding contact sleeve flared outwardly to resiliently engage the housing conductive surface.

A problem inherent with these types of contactors is that the contactor is usually made of a material different than the contact assembly and the housing conductive surface. This increases the likelihood of having a poor current path between the housing conductive surface and the contact assembly, which can result in premature failure of the connector due to high resistance hot spots causing insulation breakdown. Further, the need for providing a separate member increases the cost of the product.

Electrical connectors of this type have also usually included additional mechanical mechanisms for facilitating threaded engagement of different portions of the contact assembly when the connector is assembled. In order to provide for this threading engagement, slot and key arrangements have been used to prevent rotation of the contact assembly relative to the housing. See, for example, elements 44 and **50*h*** in the Stanger et al U.S. Pat. No. 3,930,709. In other embodiments, a mating or serrated teeth arrangement has been provided on one end of the contact assembly for engaging the housing conductive surface when the contact assembly is in a particular position. When the contact assembly is moved from this position, the teeth no longer engage.

SUMMARY OF THE INVENTION

One of the principal features of this invention is the provision of an electrical connector which includes an improved contactor for providing electrical continuity between the contact assembly and the housing conductive surface.

Another of the principal features of the invention is the provision of such a contactor which eliminates the need for a slot and key or teeth arrangement or other separate mechanism for facilitating threaded engagement of separate portions of the contact assembly by preventing rotation of the contact assembly relative to the housing.

This invention provides an electrical device comprising a housing having a passage including an electrically conductive surface fixably secured within the housing, and a contact assembly disposed in the passage and movable relative to the housing conductive surface. The contact assembly includes a member having a conductive surface, and one of the housing conductive surface and the member conductive surface has a knurl in contact with the other of the housing conductive surface and the member conductive surface so that there is continuous electrical continuity between the contact assembly and the housing conductive surface.

In one embodiment of the invention, the knurl is on the contact assembly member. The knurl on the member conductive surface eliminates one of the conductor to conductor current interchanges found in the prior art constructions. More particularly, in this embodiment, the current interchange between the contactor and the movable contact has been eliminated. This elimination of this interchange reduces the resistance of the current path which reduces heating of the assembly.

This invention also provides a first connector for use in connecting or disconnecting a high voltage circuit by engagement or disengagement of the first connector with a second connector supporting a male contact member. The first connector comprises a housing having an axial passage including an electrically conductive surface fixedly secured within the housing, and a contact assembly disposed in the passage and including a female contact element for engaging the male contact element. The contact assembly includes guide means for guiding the male contact element for movement towards the female contact element and for evolving arc-quenching gas in response to an arc being struck between the female contact element and the male contact element. The contact assembly also includes piston means responsive to the evolved gas for displacing the contact assembly towards the male contact element, and contactor means electrically connected to the female contact element for providing electrical continuity between the female contact element and the housing conductive surface. The contactor means includes a member having a knurl in interference fit contact with the housing conductive surface.

In one embodiment, the piston means is the contactor member, and the contactor member is fixedly connected to the female contact element.

Various other features of the invention are more particularly set forth in the attached drawing, the description and the appended claims.

DESCRIPTION OF A PREFERRED EMBODIMENT

Figure 1:
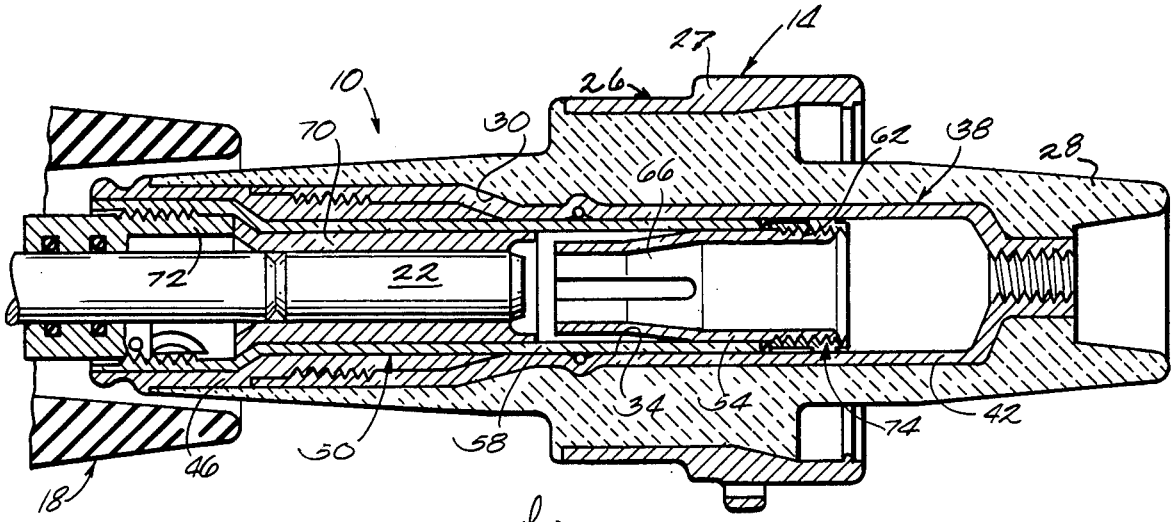
FIG. 1 is a side elevation, partially in section, of an electrical connector apparatus which embodies various of the features of the invention. The apparatus includes a first connector having a housing conductive surface and a contactor member, and the first connection is engagable with a second connector supporting a male contact element.

As illustrated in the drawings, this invention provides an electrical connector apparatus 10 comprising a first connector 14 electrically connected to a portion of a high voltage circuit (not shown) and a second connector 18 supporting a male contact element 22 electrically connected to another portion of the high voltage circuit. More particularly, the second connector 18 is in the form of a cable termination device such as an elbow. Only a portion of the second connector 18 is illustrated in FIG. 1.

Although other constructions can be used in other embodiments, in this embodiment, the first connector 14 is in the form of a bushing comprising an insulative housing 26 having two pieces 27 and 28 and having an axial passage 30 including an electrically conductive surface 34 fixedly secured within the housing 26. More particularly, the housing conductive surface 34 is provided by a shield assembly 38 including a tube shield 42 and a bushing assembly nose 46 threadably received within the tube shield 42. The first connector 14 also includes a contact assembly 50 slidably disposed in the passage 30 and including a female contact element 54 for engaging the male contact element 22.

The contact assembly 50 also includes a retaining tube 58 which locates and holds the female contact element 54 in place. More particularly, the female contact element 54 has a rough outer surface which is engaged by the retaining tube 58. The female contact element 54 has a threaded base portion 62 and spaced apart fingers 66 for resiliently engaging the male contact element 22.

The contact assembly 50 also includes guide means in the form of a guide tube 70 made of gas evolving material for guiding the male contact element 22 for movement towards the female contact element 54 and for evolving arc-quenching gas in response to an arc being struck between the female contact element 54 and the male contact element 22. The guide tube 70 is secured to the retaining tube 58 to the left (as shown in FIG. 1) of the female contact element 54, and a bushing nose assembly 72 is threaded into the retaining tube 58.

The contact assembly 50 also includes piston means responsive to the evolved gas for displacing the contact assembly 50 towards the male contact element 22. More particularly, the piston means is in the form of a piston 74 having an inner threaded portion 78 which is threaded onto the outer threaded portion 62 of the female contact element 54. When the guide tube 70 evolves gas, the gas pressure acts on the surface of the piston 74 and attempts to increase the size of the closed end of the axial passage 30 by moving the piston 74 toward the male contact element 22.

The contact assembly 50 also includes contactor means 82 for providing electrical continuity between the female contact element 54 and the housing conductive surface 34 when the contact assembly 50 is stationary and when the female contact element 54 moves relative to the housing conductive surface 34. More particularly, the contactor means 82 is electrically connected to the female contact element 54.

Figure 2:
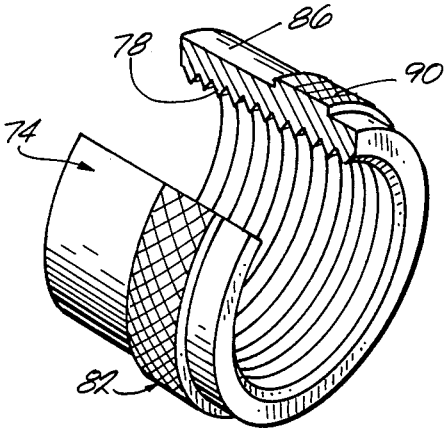
FIG. 2 is an enlarged perspective view, partially broken away, of the contactor member illustrated in FIG. 1, which member has a knurled conductive surface.
Figure 3:
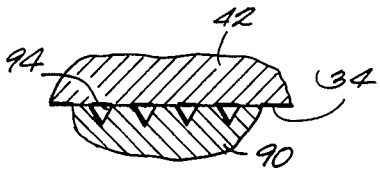
FIG. 3 is an enlarged, cross sectional view of the knurled conductive surface of the contactor member in contact with the housing conductive surface.

Although other constructions could be used in other embodiments, in this embodiment, the contactor means 82 is the piston 74. The piston 74 has a conductive surface 86 and a knurl 90. More particularly, the piston knurl 90 is in interference contact with the housing conductive surface 34. As illustrated in FIGS. 2 and 3, the knurl 90 comprises a plurality of spaced peaks 94 extending radially outwardly in a band around the piston 74. The outer diameter of the knurl 90 is greater than the inner diameter of the housing conductive surface 34 defined by the tube shield 42.

The knurl 90 on the piston 74 provides a good electrical current interchange between the female contact element 54 and the housing conductive surface 34, even as the contact assembly 50 moves relative to the housing conductive surface 34. Further, the knurl 90 holds the contact assembly 50 in interference contact with the housing conductive surface 34. This interference contact assists in the assembly of the contact assembly 50 and the housing 26 with the shield assembly 38. More particularly, the piston 74 can be located within the tube shield 42, where the knurl 90 will hold it in place, and the remainder of the contact assembly 50, including the retaining tube 58, the female contact element 54, the guide tube 70 and the nose assembly 72, can then be threaded into the piston 74.

In other embodiments (not shown) the contactor means 82 can be in the form of a member located between the piston 74 and the female contact element 54, and electrically connected to the female contact element 54.

Various other features of the invention are set forth in the following claims.

I claim:

1. An electrical device comprising a housing having a passage including an electrically conductive surface fixedly secured within said housing, and a contact assembly disposed in said passage and movable relative to said housing conductive surface, and including a member having a conductive surface, and one of said housing conductive surface and said member conductive surface having a knurl in contact with said other of said housing conductive surface and said member conductive surface so that there is continuous electrical continuity between said contact assembly and said housing conductive surface.

2. An electrical device in accordance with claim 1 wherein said knurl is on said contact assembly member.

3. A first connector for use in connecting or disconnecting a high voltage circuit by engagement or disengagement of said first connector with a second connector supporting a second connector contact element, said first connector comprising an insulative housing having an axial passage including an electrically conductive surface fixedly secured within said housing, and a contact assembly disposed in said passage and including a first connector contact element for engaging the second connector contact element, guide means for guiding the second connector contact element into said axial passage for movement towards said first connector contact element and for evolving arc-quenching gas in response to an arc being struck between said first connector contact element and the second connector contact element, piston means responsive to said evolved gas for displacing said contact assembly towards the second connector contact element, and contactor means electrically connected to said first connector contact element for providing electrical continuity between said first connector contact element and said housing conductive surface, said contactor means including a contactor member having a knurl in contact with said housing conductive surface.

4. A first connector in accordance with claim 3 wherein said piston means is said contactor member, and said contactor member is fixedly connected to the first connector contact element.

5. A first connector for use in connecting or disconnecting a high voltage circuit by engagement or disengagement of the first connector with a second connector supporting a male contact element, said first connector comprising an insulative housing having an axial passage including an electrically conductive surface fixedly secured within said housing, and a contact assembly disposed in said passage and including a female contact element for engaging the male contact element, guide means for guiding the male contact element for movement towards said female contact element and for evolving arc-quenching gas in response to an arc being struck between said female contact element and the male contact element, piston means responsive to said evolved gas for displacing said contact assembly towards the male contact element, and contactor means electrically connected to said female contact element for providing electrical continuity between said female contact element and said housing conductive surface, said contactor means including a contactor member having a knurl in interference fit contact with said housing conductive surface.

6. A first connector in accordance with claim 5 wherein said contactor member is mechanically connected to said female contact.

7. A first connector for use in connecting or disconnecting a high voltage circuit by engagement or disengagement of the first connector with a second connector supporting a male contact element, said first connector comprising an insulative housing having an axial passage including an electrically conductive surface fixedly secured within said housing, and a contact assembly disposed in said passage and including a female contact element for engaging the male contact element, guide means for guiding the male contact element for movement towards said female contact element and for evolving arc-quenching gas in response to an arc being struck between said female contact element and the male contact element, a piston responsive to said evolved gas for displacing said contact assembly towards the male contact element, and mechanically connected to said female contact element, said piston having a knurl in interference fit contact with said housing conductive surface for providing electrical continuity between said female contact element and said housing conductive surface.

* * * * *